US007992981B2

(12) United States Patent
Yokouchi

(10) Patent No.: US 7,992,981 B2
(45) **Date of Patent: *Aug. 9, 2011**

(54) LIQUID SUPPLY DEVICE AND LIQUID EJECTING APPARATUS

(75) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 343 days.

This patent is subject to a terminal disclaimer.

(21) Appl. No.: 12/331,880

(22) Filed: Dec. 10, 2008

(65) Prior Publication Data

US 2009/0147053 A1 Jun. 11, 2009

(30) Foreign Application Priority Data

Dec. 11, 2007 (JP) ..... 2007-319815
Aug. 29, 2008 (JP) ..... 2008-222047

(51) Int. Cl.
*B41J 2/175* (2006.01)
*B41J 2/17* (2006.01)

(52) U.S. Cl. ..... 347/85; 347/6; 347/7; 347/17; 347/84

(58) Field of Classification Search ..... 347/6, 7, 347/17, 84, 85
See application file for complete search history.

(56) References Cited

U.S. PATENT DOCUMENTS 4,336,547 A 6/1982 Matsumoto et al.
6,059,405 A * 5/2000 Mochizuki et al. ..... 347/92
2006/0082621 A1* 4/2006 Tsukada et al. ..... 347/85
2006/0268078 A1 11/2006 Kumagai
2009/0147054 A1 6/2009 Yorouchi

FOREIGN PATENT DOCUMENTS

| | | |
|---|---|---|
| EP | 0 903 235 A2 | 3/1999 |
| JP | 08-067010 | 3/1996 |
| JP | 09-011488 | 1/1997 |
| JP | 11-342634 | 12/1999 |
| JP | 2002-355992 | 12/2002 |
| JP | 2004-090453 | 3/2004 |
| JP | 2005-131939 | 5/2005 |
| JP | 2005-288767 | 10/2005 |
| JP | 2006-212846 | 8/2006 |
| JP | 2006-272661 | 10/2006 |

* cited by examiner

*Primary Examiner* — Ryan Lepisto
(74) *Attorney, Agent, or Firm* — Workman Nydegger

(57) ABSTRACT

A liquid supply device includes a liquid supply channel that supplies a liquid from an upstream side as a liquid supply source side to a downstream side, where the liquid is consumed, and a pump that pumps a part of the liquid supply channel as a pump chamber. A first one-way valve in the liquid supply channel on an upstream side from the pump chamber permits ink to flow from the upstream side to the downstream side. A second one-way valve on a downstream side from the pump chamber permits ink to flow from the upstream side toward the downstream side. A liquid pressure accumulation unit with a volume variable pressure accumulation chamber is disposed on a downstream side from the second one-way valve to form a part of the liquid supply channel and stores the liquid in a pressure-accumulated state within the pressure accumulation chamber.

9 Claims, 3 Drawing Sheets

LIQUID SUPPLY DEVICE AND LIQUID EJECTING APPARATUS

BACKGROUND

The entire disclosure of Japanese Patent Application No. 2007-319815, filed Dec. 11, 2007 and Japanese Patent Application No. 2008-222047, filed Aug. 29, 2008, are expressly incorporated herein by reference.

1. Technical Field

The present invention relates to a liquid supply device that supplies a liquid from an upstream side as a liquid supply source side to a downstream side, on which the liquid is consumed, and a liquid ejecting apparatus.

2. Related Art

An ink jet printer (hereinafter, simply referred to as "printer") is a known example of a liquid ejecting apparatus for ejecting a liquid onto a target. This printer ejects ink (liquid), which is supplied to a recording head (liquid ejecting head), from nozzles formed in the recording head, thereby performing printing on a recording medium as the target. In recent years, as described in JP-A-2006-272661, a printer is suggested in which a pump is provided in an ink flow channel connecting an ink cartridge (liquid supply source) and the recording head to pump ink in order to pressurize and supply ink from the ink cartridge to the recording head.

That is, in the printer described in JP-A-2006-272661, a part of the ink flow channel forms a pump chamber of the pump, and the pump chamber is provided with an ink inlet port that introduces ink from the ink cartridge, and an ink outlet port that discharges ink to the recording head. One-way valves are individually provided in the ink flow channel between the ink cartridge and the ink inlet port and between the recording head and the ink outlet port to permit ink to flow only in a direction from an upstream side toward a downstream side, that is, from the ink cartridge toward the recording head. If the pump performs a suction action, negative pressure is applied to the pump chamber, and accordingly ink is sucked into the pump chamber from the ink cartridge. Ink is supplied to the recording head in a pressurized state in accordance with an ejection action of the pump.

In the printer of JP-A-2006-272661, the negative pressure is generated by the suction action of the pump, and causes ink to be sucked into the pump chamber through the ink flow channel. The negative pressure is applied to the ink flow channel on a downstream side from the pump chamber, as well as the ink flow channel on the upstream side. For this reason, while the pump performs the suction action, the negative pressure toward the upstream side is applied to ink in the ink flow channel on a downstream side from the pump. Accordingly, ink may not be supplied to the recording head on the downstream side in a pressurized state. As a result, in the printer in which the pump is provided in the ink flow channel connecting the ink cartridge and the recording head, during the pump action, ink for printing may not be ejected from the recording head for a moment.

SUMMARY

An advantage of some aspects of the invention is that it provides a liquid supply device that can pressurize and supply a liquid toward a downstream side, on which the liquid is consumed, when a pump provided in a liquid supply channel sucks the liquid into a pump chamber, and a liquid ejecting apparatus including the liquid supply device.

According to an aspect of the invention, a liquid supply device includes a liquid supply channel that supplies a liquid from an upstream side as a liquid supply source side to a downstream side, on which the liquid is consumed, a pump that pumps a part of the liquid supply channel as a pump chamber, a first one-way valve that is provided in the liquid supply channel on an upstream side from the pump chamber to permit ink to flow from the upstream side to the downstream side, a second one-way valve that is provided in the liquid supply channel on a downstream side from the pump chamber to permit ink to flow from the upstream side toward the downstream side, and a liquid pressure accumulation unit that is provided with a volume variable pressure accumulation chamber, which is disposed in the liquid supply channel on a downstream side from the second one-way valve to form a part of the liquid supply channel, and stores the liquid in a pressure-accumulated state within the pressure accumulation chamber.

With this configuration, if the pump performs a pump action, the liquid is sucked into the pump chamber from the upstream side as the liquid supply source side through the first one-way valve, and the liquid is ejected from the pump chamber toward the downstream side and passes through the second one-way valve. The liquid passing through the second one-way valve is temporarily stored in the pressure accumulation chamber of the liquid pressure accumulation unit. In this case, the pressure accumulation chamber of the liquid pressure accumulation unit has a variable volume. Accordingly, when an urging force is applied in a direction to decrease the volume, the liquid in the pressure accumulation chamber is stored in a pressure-accumulated state. A backflow of the liquid stored in the pressure-accumulated state toward the pump chamber is suppressed by the second one-way valve, and the liquid is pressurized and supplied toward the downstream side, on which the liquid is consumed. For this reason, the liquid can be stably pressurized and supplied from the upstream side as the liquid supply source side toward the downstream side, on which the liquid is consumed, without adversely affecting the state of the pump, which repeatedly performs liquid suction and ejection actions.

In the liquid supply device according to the aspect of the invention, the liquid pressure accumulation unit may include an urging unit that applies a predetermined urging force in a direction to decrease the volume of the pressure accumulation chamber.

With this configuration, the urging force of the urging unit is applied in the direction to decrease the volume of the pressure accumulation chamber. Therefore, the liquid that flows from the pump chamber on the upstream side into the pressure accumulation chamber forming a part of the liquid supply channel through the second one-way valve can be maintained in the pressurize and pressure-accumulated state. As a result, the liquid stored in the pressure accumulation chamber can be stably supplied to the downstream side in a pressurized state.

According to another aspect of the invention, a liquid supply device includes a liquid supply channel that supplies a liquid from an upstream side as a liquid supply source side to a downstream side, on which the liquid is consumed, a pump that pumps a part of the liquid supply channel as a pump chamber, a first one-way valve that is provided in the liquid supply channel on an upstream side from the pump chamber to permit the liquid to flow only in a direction from the upstream side to the downstream side, a second one-way valve that is provided in the liquid supply channel on a downstream side from the pump chamber to permit the liquid to flow only in a direction from the upstream side to the downstream side, and a liquid pressure accumulation unit that is provided in the liquid supply channel on a downstream side from the second one-way valve and stores the liquid in a pressure-accumulated state.

With this configuration, if the pump performs a pump action, the liquid is sucked into the pump chamber from the upstream side as the liquid supply source side through the first one-way valve, and the liquid is ejected from the pump chamber toward the downstream side and passes through the second one-way valve. The liquid passing through the second one-way valve is temporarily stored in the liquid pressure accumulation unit in the pressure-accumulated state. A backflow of the liquid stored in the liquid pressure accumulation unit in the pressure-accumulated state toward the pump chamber is suppressed by the second one-way valve, and the liquid is pressurized and supplied toward the downstream side, on which the liquid consumed. For this reason, the liquid can be stably pressurized and supplied from the upstream side as the liquid supply source side toward the downstream side, on which the liquid is consumed, without adversely affecting the state of the pump, which repeatedly performs liquid suction and ejection actions.

In the liquid supply device according to another aspect of the invention, the liquid pressure accumulation unit may include a volume variable pressure accumulation chamber that forms a part of the liquid supply channel, and a displacement member that is displaceable to increase and decrease the volume of the pressure accumulation chamber, and is constantly urged by a predetermined urging force so as to be displaced in a direction to decrease the volume of the pressure accumulation chamber.

With this configuration, the liquid that flows into the volume variable pressure accumulation chamber, which forms a part of the liquid supply channel, from the pump chamber on the upstream side through the second one-way valve is displaced by the displacement member against the urging force. Therefore, the liquid can be stored in the pressure-accumulated state. In addition, the liquid stored in the pressure-accumulated state is displaced by the displacement member in an urging direction. As a result, the liquid can be stably supplied from the pressure accumulation chamber to the downstream side in a pressurized state.

In the liquid supply device according to another aspect of the invention, when the pressure of the liquid ejected from the pump chamber in accordance with an ejection action of the pump is applied as positive pressure, the displacement member may be displaced in a direction to increase the volume of the pressure accumulation chamber against the urging force.

With this configuration, the liquid in the pressure-accumulated state flows out to the downstream side from the pressure accumulation chamber as the liquid is consumed on the downstream side, and the volume of the pressure accumulation chamber is gradually decreased. For this reason, the pressure of the liquid in the pressure accumulation chamber is gradually decreased. Meanwhile, if the liquid ejected from the pump chamber in accordance with the ejection action of the pump newly flows into the pressure accumulation chamber, the volume of the pressure accumulation chamber is increased again, and the pressure of the liquid in the pressure accumulation chamber is increased. Therefore, the pump action can be performed at an appropriate timing, and thus the liquid can be constantly pressurized and supplied to the downstream side, on which the liquid is consumed.

In the liquid supply device according to another aspect of the invention, the pump may include a displacement member that is displaced so as to increase and decrease the volume of the pump chamber, and an urging member that urges the displacement member in a direction to decrease or increase the volume of the pump chamber.

With this configuration, when the pump performs a pump action to supply the liquid, the displacement member is configured to be displaced against the urging force of the urging member only if the pump performs one of a suction action and an ejection action. Otherwise, the displacement member is displaced to an original state by the urging force of the urging member. Therefore, a drive load of the pump can be reduced.

In the liquid supply device according to another aspect of the invention, the displacement member of the pump and the displacement member of the liquid pressure accumulation unit may be formed of a single flexible member.

With this configuration, portions of the single flexible member corresponding to the pump chamber and the pressure accumulation chamber are individually used as the displacement member of the pump and the displacement member of the liquid pressure accumulation unit. Therefore, the number of parts of the device can be reduced.

In the liquid supply device according to another aspect of the invention, a portion of the single flexible member corresponding to the pump chamber may be displaced so as to increase and decrease the volume of the pump chamber when the pump performs a pump action, and a portion of the single flexible member corresponding to the pressure accumulation chamber may be urged by a predetermined urging force so as to be displaced in a direction to decrease the volume of the pressure accumulation chamber.

With this configuration, in the flexible member forming the displacement members of the pump and the liquid pressure accumulation unit, the portion corresponding to the pressure accumulation chamber is urged by the urging member. Therefore, the liquid stored in the pressure accumulation chamber is displaced by the displacement member in the urging direction. As a result, the liquid can be stably supplied from the pressure accumulation chamber toward the downstream side in the pressurized state.

In the liquid supply device according to another aspect of the invention, the first one-way valve may include a displacement member that is displaced in a direction to permit the liquid to flow in the liquid supply channel when the pressure of the liquid sucked into the pump chamber in accordance with the suction action of the pump is applied as negative pressure. The displacement member of the first one-way valve and at least one of the displacement member of the pump and the displacement member of the liquid pressure accumulation unit may be formed of a single flexible member.

With this configuration, from among the displacement members corresponding to the first one-way valve, the pump chamber, and the pressure accumulation chamber, the displacement member of the first one-way valve and at least one of the displacement member of the pump and the displacement member of the liquid pressure accumulation unit are formed of a single flexible member. Therefore, the number of parts of the device can be reduced.

According to yet another aspect of the invention, a liquid ejecting apparatus includes a liquid ejecting head that ejects a liquid, and the above-described liquid supply device.

With this configuration, the liquid is supplied in the pressurized state from the liquid pressure accumulation unit, which stores the liquid in the liquid supply channel between the pump chamber and the liquid ejecting head in the pressure-accumulated state, to the liquid ejecting head on the downstream side. For this reason, the pump, which is provided in the liquid supply channel and performs the pump action to supply the liquid to the downstream side, that is, to the liquid ejecting head, does not need to apply excessive pressure to the liquid. Therefore, the pump can be reduced in size, and as a result the liquid ejecting apparatus can be reduced in size.

In the liquid ejecting apparatus according to yet another aspect of the invention, when the liquid ejecting head ejects the liquid and consumes the liquid, the liquid may be supplied to the liquid ejecting head from a valve unit, which temporarily stores the liquid to be supplied from the liquid supply device, in an amount corresponding to the amount of the liquid consumed by the ejection.

With this configuration, the liquid supplied from the liquid supply device is temporarily stored in the valve unit, and the liquid is supplied to the liquid ejecting head in an amount corresponding to the amount of the liquid consumed by the liquid ejecting head. For this reason, the pressurized liquid can be prevented from being directly supplied to the liquid ejecting head, and thus liquid leakage from the liquid ejecting head can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is applied to an ink jet recording apparatus (hereinafter, referred to as "printer"), which is a kind of liquid ejecting apparatus, will be described with reference to FIGS. 1 to 3B.

Figure 1:
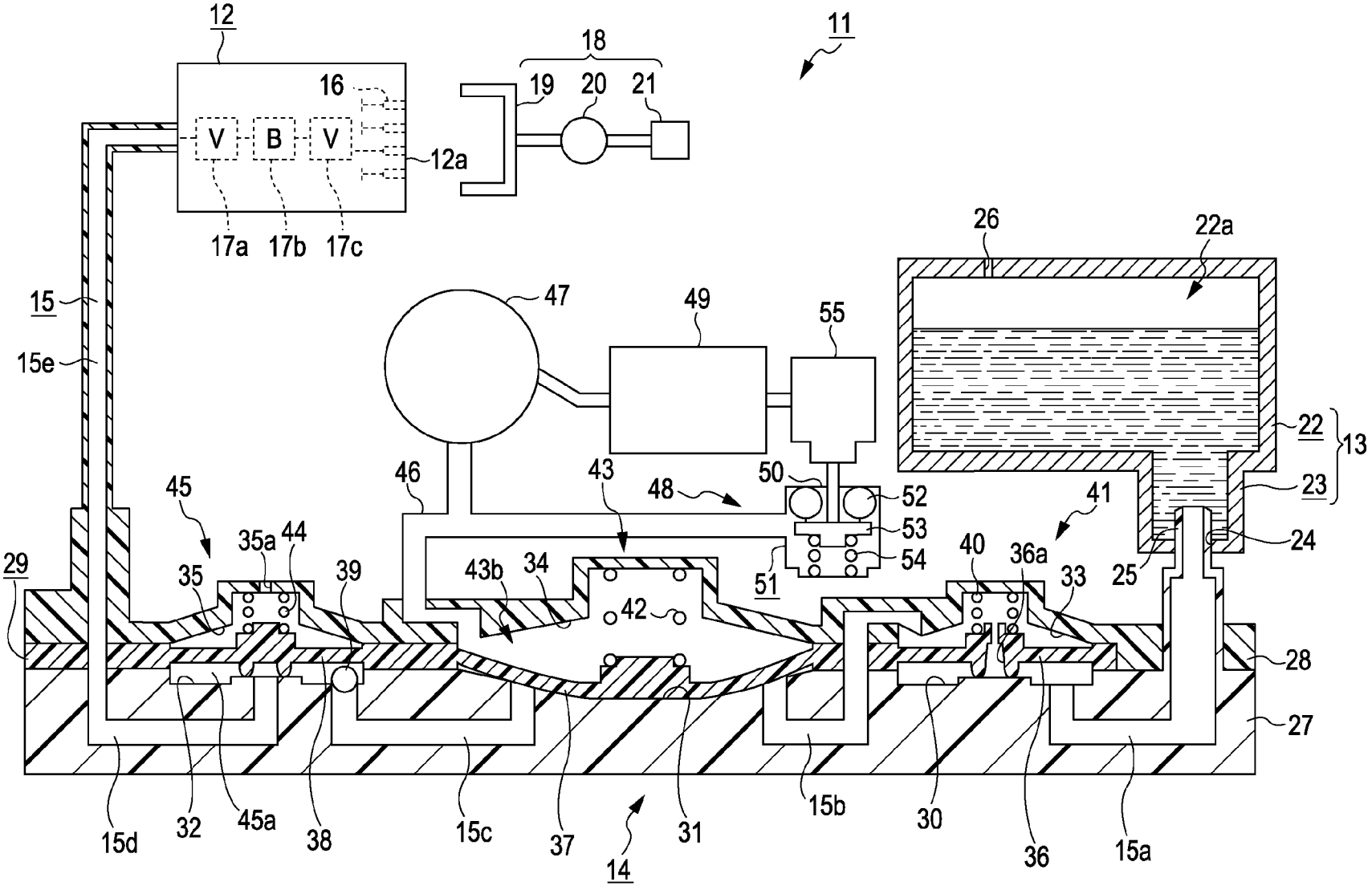
FIG. 1 is a schematic view of an ink jet printer according to an embodiment of the invention.

As shown in FIG. 1, a printer 11 of this embodiment includes a recording head 12 serving as a liquid ejecting head that ejects ink (liquid) onto a target (not shown), and an ink supply device 14 serving as a liquid supply device that supplies, to the recording head 12, ink contained in an ink cartridge 13 serving as a liquid supply source. An ink flow channel (liquid supply channel) 15 is provided through which ink is supplied from an upstream side toward a downstream side, that is, from the ink cartridge 13 toward the recording head 12, in a state where an upstream end of the ink supply device 14 is connected to the ink cartridge 13, and a downstream end of the ink supply device 14 is connected to the recording head 12.

The printer 11 includes a plurality of ink supply devices 14 corresponding to the number of colors (types) of ink used in the printer 11. However, the ink supply devices 14 have the same configuration, and thus FIG. 1 shows one ink supply device 14, which supplies ink of one color, together with the recording head 12 and one ink cartridge 13. In the following description, a case in which ink is supplied from the ink cartridge 13 on the upstream side toward the recording head 12 on the downstream side through the ink flow channel 15 of the one ink supply device 14 shown in FIG. 1 will be described.

As shown in FIG. 1, in the recording head 12, a plurality of nozzles 16 (in this embodiment, four nozzles) corresponding to the number of ink supply devices 14 are formed on a nozzle forming surface 12*a*, which is opposite a platen (not shown). Ink is supplied to each nozzle 16 from the ink flow channel 15 of the ink supply device 14 corresponding to the nozzle 16 through a choke valve 17*a*, a buffer 17*b*, and a self-sealing valve 17*c* serving as a valve unit.

The choke valve 17*a* is a valve that closes an ink flow channel in the recording head 12, in which ink supplied from the ink flow channel 15 flows, at a predetermined position in order to perform choke cleaning during maintenance of the recording head 12. For this reason, the choke valve 17*a* is open in a normal state including printing, other than cleaning.

The buffer 17*b* is an ink storage chamber that temporarily stores ink. For example, when a large amount of ink is ejected from the nozzle 16 of the recording head 12 per scanning operation as in solid printing, and when ink is not being supplied due to a suction action of a pump 43, the buffer 17*b* is provided in order to store extra ink in advance such that there is a sufficient amount of ink in the recording head 12. The buffer 17*b* has a volume that can store ink in an amount corresponding to the maximum amount of ink to be filled in the recording head 12 with a small amount of margin while ink is not being supplied due to the suction action of the pump 43.

The self-sealing valve 17*c* is a valve that, when ink is ejected from the nozzle 16, is opened and closed to supply ink in an amount corresponding to the amount of ink consumed by the ejection while ink pressure (head supply pressure) is adjusted as required by the recording head 12. The self-sealing valve 17*c* of this embodiment is a diaphragm-type differential pressure valve that is opened and closed by a differential pressure between the atmospheric pressure and the ink pressure. In order to apply an appropriate ink pressure to the recording head 12, a predetermined ink pressure is applied to a pressure chamber (not shown) of the self-sealing valve 17*c*.

The printer 11 includes a maintenance unit 18 disposed at a home position of the recording head 12 to be used when printing is not being performed. The maintenance unit 18 cleans the recording head 12 in order to eliminate clogging of the nozzle 16 of the recording head 12. The maintenance unit 18 includes a cap 19 that comes into contact with the nozzle forming surface 12*a* of the recording head 12 so as to surround the nozzle 16, a suction pump 20 that is driven in order to suck ink from the cap 19, and a waste liquid tank 21, to which ink sucked from the cap 19 is discharged as waste ink when the suction pump 20 is driven. During cleaning, in a state where the cap 19 is moved from the state shown in FIG. 1 and comes into contact with the nozzle forming surface 12*a* of the recording head 12, the suction pump 20 is driven. Then, negative pressure is generated in the inner space of the cap 19, and thickened ink or ink mixed with air bubbles is sucked and discharged from the recording head 12 toward the waste liquid tank 21.

At this time, the choke valve 17*a* is closed, and ink in the flow channel including the buffer 17*b* and the self-sealing valve 17*c* has negative pressure. Thereafter, the pump 43 starts an ejection action, and the choke valve 17*a* is opened. In this way, choke cleaning is performed over the entire region, in which the negative pressure is generated, on a downstream side from an open position of the choke valve 17*a*, such that pressurized ink supplied from the pump 43 flows at the time of the stroke.

Meanwhile, the ink cartridge 13 has a substantially boxlike case 22 in which an ink chamber 22*a* for containing ink is formed. A cylinder 23 communicating with the ink chamber 22*a* is formed to protrude downward from a bottom wall of the case 22, and an ink supply port 24 for discharging ink is formed at a front end of the cylinder 23. When the ink cartridge 13 is connected to the ink supply device 14, an ink supply needle 25, which protrudes from the ink supply device 14 to form an upstream end of the ink flow channel 15, is inserted into the ink supply port 24. An atmosphere communicating hole 26 is formed to pass through an upper wall of the case 22 to enable communication between the ink chamber 22*a* containing ink and the atmosphere, such that atmospheric pressure is applied to the surface of ink contained in the ink chamber 22*a*.

Next, the configuration of the ink supply device 14 will be described in detail.

As shown in FIG. 1, the ink supply device 14 includes a first flow channel forming member 27 that is made of resin and serves as a base, a second flow channel forming member 28 that is made of resin and laminated on the first flow channel forming member 27, and a flexible member 29 that is made of a rubber plate and sandwiched between the flow channel forming members 27 and 28 during assembly. Concave portions 30, 31, and 32 having a circular shape in plan view are formed at a plurality of positions (in this embodiment, three positions) on an upper surface of the first flow channel forming member 27. Referring to FIG. 1, one concave portion 31 and two concave portions 30 and 32, which substantially have the same volume so as to be smaller than that of the concave portion 31, are arranged in a horizontal direction so that the concave portion 30, the concave portion 31, and the concave portion 32 are disposed from right to left.

Concave portions 33, 34, and 35 having a circular shape in plan view are formed at a plurality of positions (in this embodiment, three positions) on a lower surface of the second flow channel forming member 28 laminated on the first flow channel forming member 27 so as to be opposite the concave portions 30, 31, and 32 of the upper surface of the first flow channel forming member 27. Referring to FIG. 1, one concave portion 34 and two concave portions 33 and 35, which substantially have the same volume so as to be smaller than that of the concave portion 34, are arranged in a horizontal direction so that the concave portion 33, the concave portion 34, and the concave portion 35 are disposed from right to left.

That is, in the ink supply device 14, the concave portions 30 to 32 or the concave portions 33 to 35 are formed on the same plane, and thus a laminate in which a plurality of plate-shaped members are laminated can be used.

An atmosphere communicating hole 35*a* communicating with the atmosphere is formed in the bottom of the leftmost concave portion 35 in the second flow channel forming member 28 of FIG. 1.

The flexible member 29 is sandwiched between the first flow channel forming member 27 and the second flow channel forming member 28, such that the flexible member 29 is interposed to vertically divide the spaces between the concave portions 30 to 32 of the first flow channel forming member 27 and the concave portions 33 to 35 of the second flow channel forming member 28 at a plurality of positions (in this embodiment, three positions). As a result, a portion of the flexible member 29 interposed between the concave portion 30 of the first flow channel forming member 27 and the concave portion 33 of the second flow channel forming member 28 functions as a suction-side valve body (displacement member) 36 that is elastically deformed between the concave portions 30 and 33 so as to be displaced.

Similarly, a portion of the flexible member 29 interposed between the concave portion 31 of the first flow channel forming member 27 and the concave portion 34 of the second flow channel forming member 28 functions as a diaphragm (displacement member) 37 that is elastically deformed between the concave portions 31 and 34 so as to be displaced. In addition, a portion of the flexible member 29 interposed between the concave portion 32 of the first flow channel forming member 27 and the concave portion 35 of the second flow channel forming member 28 functions as an ejection-side valve body (displacement member) 38 that is elastically deformed between the concave portions 32 and 35 so as to be displaced.

In regard to the area of a deformable portion in plan view of each of the suction-side valve body 36, the diaphragm 37, and the ejection-side valve body 38, the suction-side valve body 36 and the ejection-side valve body 38 substantially have the same size, and the diaphragm 37 is larger than the suction-side valve body 36 and the ejection-side valve body 38.

As shown in FIG. 1, a first flow channel 15*a* is formed in the first flow channel forming member 27 and the second flow channel forming member 28 to enable communication between the ink supply needle 25 protruding from the upper surface of the second flow channel forming member 28 and the concave portion 30 of the first flow channel forming member 27. The first flow channel 15*a* forms a part of the ink flow channel 15 in the ink supply device 14. Similarly, a second flow channel 15*b* is formed in the first flow channel forming member 27, the second flow channel forming member 28, and the flexible member 29 to enable communication between the concave portion 33 of the second flow channel forming member 28 and the concave portion 31 of the first flow channel forming member 27. The second flow channel 15*b* forms a part of the ink flow channel 15 in the ink supply device 14.

A third flow channel 15*c* is formed in the first flow channel forming member 27 to enable communication between the concave portion 31 and the concave portion 32 of the first flow channel forming member 27. The third flow channel 15*c* forms a part of the ink flow channel 15 in the ink supply device 14. A ball valve 39 is provided at a flow channel opening end formed in an inner bottom surface of the concave portion 32 on the downstream side in the third flow channel 15*c*. The ball valve 39 functions as a second one-way valve that permits ink to flow only in a direction from the upstream side to the downstream side, that is, from the concave portion 31 toward the concave portion 32. The ball valve 39 is constantly urged by an urging member (not shown) in a valve closing direction to close the third flow channel 15*c*.

A fourth flow channel 15*d* is formed in the first flow channel forming member 27, the second flow channel forming member 28, and the flexible member 29 to enable communication between the concave portion 32 of the first flow channel forming member 27 and the upper surface of the second flow channel forming member 28. The fourth flow channel 15*d* forms a part of the ink flow channel 15 in the ink supply device 14. A flow channel opening end formed in the upper surface of the second flow channel forming member 28 in the fourth flow channel 15*d* is connected to one end (upstream end) of an ink supply tube 15*e*, which forms a part of the ink flow channel 15 in the ink supply device 14. The other end (downstream end) of the ink supply tube 15*e* is connected to the choke valve 17*a* in the recording head 12.

As shown in FIG. 1, a portion of the flexible member 29 forming the suction-side valve body 36 in the ink supply device 14 has a through hole 36*a* in a central portion thereof, and is urged toward an inner bottom surface of the lower concave portion 30 by an urging force of a coil spring 40 provided in the upper concave portion 33. In this embodiment, the concave portions 30 and 33, the suction-side valve body 36, and the coil spring 40 form a suction-side valve 41 serving as a first one-way valve. The suction-side valve 41 permits ink to flow only in a direction from the upstream side, on which the ink cartridge 13 is disposed, toward the downstream side, on which ink is consumed by ejection from the recording head 12.

Similarly, a portion of the flexible member 29 forming the diaphragm 37 in the ink supply device 14 is urged toward an inner bottom surface of the lower concave portion 31 by an urging force of a coil spring (urging member) 42 provided in the upper concave portion 34. In this embodiment, the concave portions 31 and 34, the diaphragm 37, and the coil spring 42 form a pump 43. A variable volume space, which is defined by the diaphragm 37 and the lower concave portion 31, functions as a pump chamber 43*a* (see FIGS. 2A and 2B) in the pump 43.

Similarly, a portion of the flexible member 29 forming the ejection-side valve body 38 in the ink supply device 14 is urged toward an inner bottom surface of the lower concave portion 32 by an urging force of a coil spring 44 serving as an urging unit provided in the upper concave portion 35. In this embodiment, the concave portions 32 and 35, the ejection-side valve body 38, and the coil spring 44 form an ejection-side valve 45 serving as a liquid pressure accumulation unit that stores ink in a pressure-accumulated state. A volume variable space, which is defined by the ejection-side valve body 38 and the lower concave portion 32, functions as a pressure accumulation chamber 45*a* that forms a part of the ink flow channel 15 and stores ink in the pressure-accumulated state. The pressure accumulation chamber 45*a* has a volume smaller than that of the pump chamber 43*a*, and substantially has the same size as a space defined by the concave portion 32 and the suction-side valve body 36. The urging force of the coil spring 44 is applied in a direction to decrease the volume of the pressure accumulation chamber 45*a*.

As shown in FIG. 1, a negative pressure generation device 47 including a suction pump, and an atmosphere opening mechanism 48 are connected to the concave portion 34 of the second flow channel forming member 28 through a two-branch air flow channel 46. When a driving motor 49, which can rotate forward and reversely, is driven forward, the negative pressure generation device 47 is driven by a driving force to be transferred through a one-way clutch (not shown) and generates negative pressure. Similarly, the negative pressure generation device 47 generates negative pressure in the concave portion 34 of the second flow channel forming member 28 connected thereto through the air flow channel 46. From this viewpoint, a volume variable space, which is defined by the concave portion 34 of the second flow channel forming member 28 and the diaphragm 37, functions as a negative pressure chamber 43*b*, which is put in a negative pressure state when the negative pressure generation device 47 is driven.

The atmosphere opening mechanism 48 includes an atmosphere opening valve 53 that is accommodated in a box 51 having an atmosphere opening hole 50 formed therein with a seal member 52 attached to the atmosphere opening hole 50. The atmosphere opening valve 53 is urged by an urging force of a coil spring 54 in a valve closing direction to seal the atmosphere opening hole 50. When the driving motor 49 is driven reversely, the atmosphere opening mechanism 48 is configured such that a cam mechanism 55 is actuated by the driving force to be transferred through the one-way clutch (not shown), and the atmosphere opening valve 53 is displaced in a valve opening direction against the urging force of the coil spring 54 when the cam mechanism 55 is actuated. That is, when the negative pressure chamber 43*b* connected to the atmosphere opening mechanism 48 through the air flow channel 46 is in the negative pressure state, the atmosphere opening valve 53 is opened, and thus the atmosphere opening mechanism 48 opens the negative pressure chamber 43*b* to the atmosphere to release the negative pressure state.

FIG. 1 shows a case in which the negative pressure generation device 47, the atmosphere opening mechanism 48, and the driving motor 49 driving them are individually provided in a plurality of ink supply devices 14 corresponding to ink of respective colors. Alternatively, the following configuration may be used. An end of the air flow channel 46, which is connected to the negative pressure chamber 43*b* of the pump 43 in the ink supply device 14, may branch off so as to correspond to the number of ink supply devices 14 corresponding to ink of the respective colors, and each end of the air flow channel 46 may be connected to the negative pressure chamber 43*b* of the pump 43 in a corresponding one of the ink supply devices 14. With this configuration, a single negative pressure generation device 47, a single atmosphere opening mechanism 48, and a single driving motor 49 may be provided for a plurality of ink supply devices 14, thereby driving the ink supply devices 14 of the respective colors. Therefore, the printer 11 can be reduced in size.

The operation of the printer 11 having the above-described configuration will be described, focusing on the operation of the ink supply device 14.

It is assumed that the state shown in FIG. 1 is immediately after an ink cartridge is replaced with a new one, and the suction-side valve body 36 of the suction-side valve 41, the diaphragm 37 of the pump 43, and the ejection-side valve body 38 of the ejection-side valve 45 are all pressed against the inner bottom surfaces of the concave portions 30, 31, and 32 by the urging force of the coil springs 40, 42, and 44. It is also assumed that the ball valve 39, which opens and closes the third flow channel 15*c* in the ink flow channel 15 of the ink supply device 14, is urged at a valve close position by an urging member (not shown), and the atmosphere opening mechanism 48 is in a valve close state where the atmosphere opening valve 53 seals the atmosphere opening hole 50.

In the state of FIG. 1, when the ink supply device 14 supplies ink from the ink cartridge 13 to the recording head 12, first, the driving motor 49 is driven forward so as to cause the pump 43 to perform a pump action. When this happens, the negative pressure generation device 47 generates negative pressure, and the negative pressure chamber 43*b* of the ink supply device 14 connected to the negative pressure generation device 47 through the air flow channel 46 is put in the negative pressure state. For this reason, the diaphragm 37 of the pump 43 is elastically deformed (displaced) toward the negative pressure chamber 43*b* against the urging force of the coil spring 42, and decreases the volume of the negative pressure chamber 43*b* (see FIG. 2A). As the volume of the negative pressure chamber 43*b* decreases, the pump chamber 43*a* of the pump 43, which is separated from the negative pressure chamber 43*b* by the diaphragm 37, reversely increases in volume.

That is, the pump 43 displaces the diaphragm 37 in a direction to increase the volume of the pump chamber 43*a* and performs the suction action. Specifically, the diaphragm 37 is displaced from a bottom dead point shown in FIG. 1 to a top dead point shown in FIG. 2A. For this reason, the pump chamber 43*a* is put in a negative pressure state, and the negative pressure is applied to the upper concave portion 33 of the suction-side valve 41 through the second flow channel 15*b*. The negative pressure causes the suction-side valve body 36 to be elastically deformed (displaced) upward (that is, in a valve opening direction) in accordance with a pressure difference from the pressure of ink in the lower concave portion 30 against the urging force of the coil spring 40. As a result, the first flow channel 15*a* and the second flow channel 15*b* communicate with each other through the through hole 36*a* of the suction-side valve body 36, and thus ink is sucked into the pump chamber 43*a* from the ink cartridge 13 through the first flow channel 15*a*, the concave portion 30, the through hole 36*a*, the concave portion 33, and the second flow channel 15*b*.

When the pump 43 performs the suction action, the negative pressure of the pump chamber 43*a* is also applied to a downstream side of the ink flow channel 15 from the pump chamber 43*a*, that is, the third flow channel 15*c*, through the third flow channel 15*c*. However, the ball valve 39 is urged in the valve closing direction at a downstream end of the third flow channel 15*c*, and the valve close state is not changed to a valve open state unless a positive ink ejection pressure (for example, a pressure of 3 kpa or more) is applied to the ball valve 39 from an upstream side of the third flow channel 15*c* by the ejection action of the pump 43. In this case, the negative pressure is applied to the ball valve 39, and thus the valve close state is maintained.

Figure 2A:
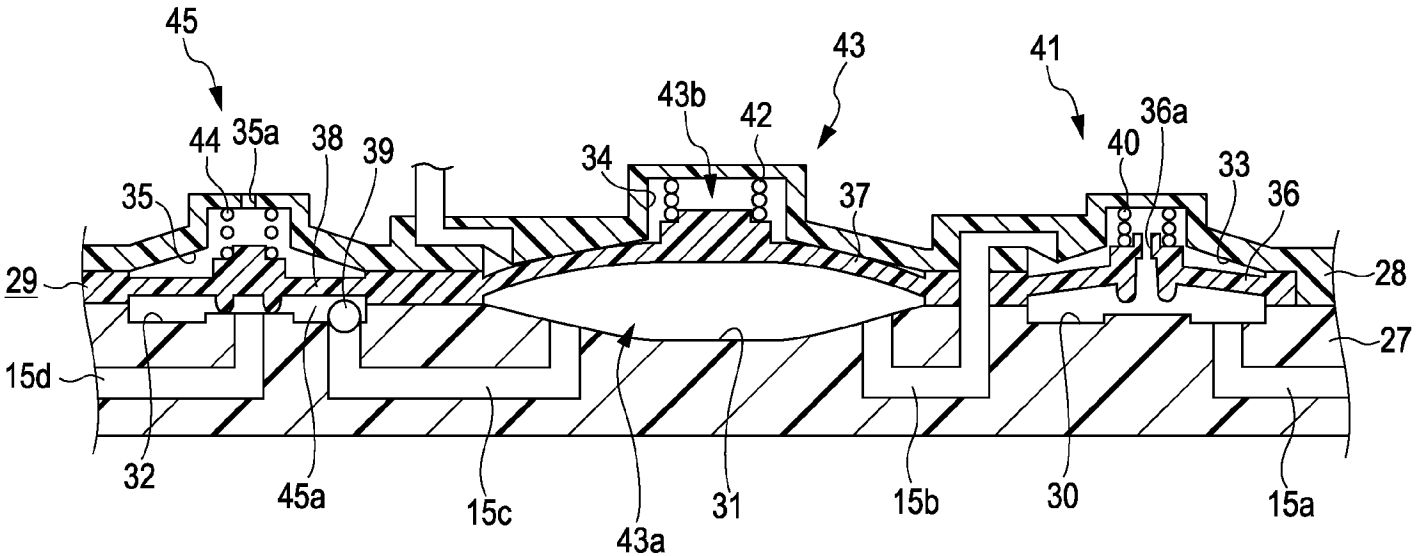
FIG. 2A is a schematic view of a liquid supply device when a pump performs a suction action.

Next, in the state of FIG. 2A, the driving motor 49 is driven reversely. When this happens, the cam mechanism 55 of the atmosphere opening mechanism 48 is actuated, and the atmosphere opening valve 53 is opened against the urging force of the coil spring 54. Then, the negative pressure chamber 43*b* in the negative pressure state is opened to the atmosphere. For this reason, the diaphragm 37 of the pump 43 is elastically deformed (displaced) downward (that is, toward an inner bottom surface of the pump chamber 43*a*) by the urging force of the coil spring 42, and increases the volume of the negative pressure chamber 43*b* (see FIG. 2B). As the volume of the negative pressure chamber 43*b* increases, the pump chamber 43*a* of the pump 43, which is separated from the negative pressure chamber 43*b* by the diaphragm 37, reversely decreases in volume.

Figure 2B:
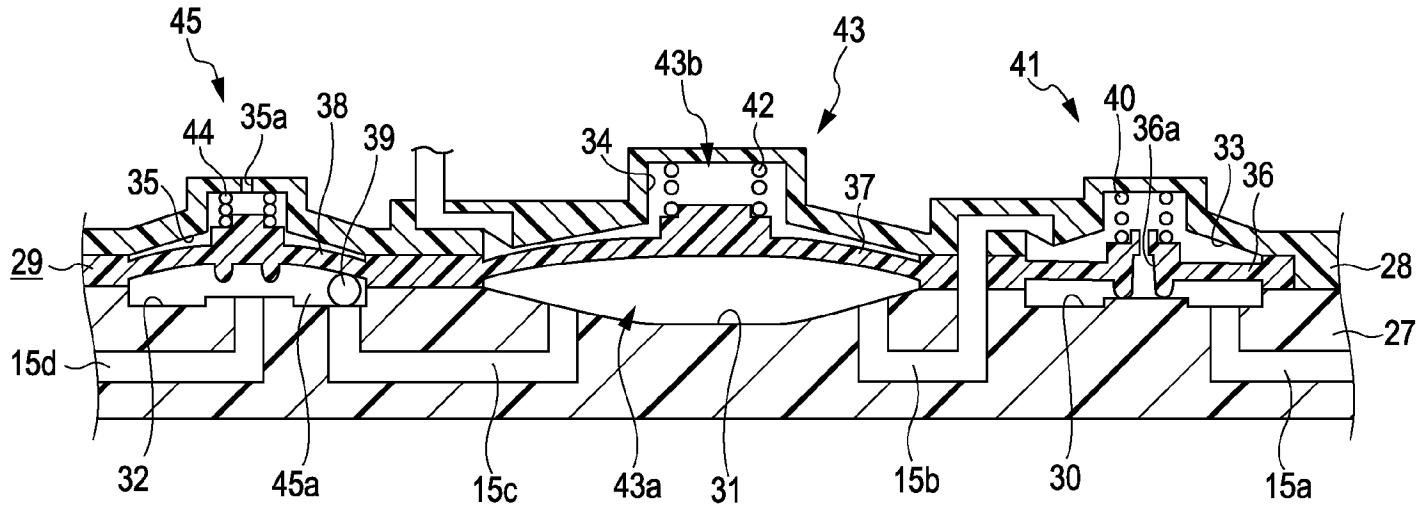
FIG. 2B is a schematic view of a liquid supply device when a pump performs an ejection action.

That is, the pump 43 displaces the diaphragm 37 in a direction to decrease the volume of the pump chamber 43*a* and performs the ejection action. Specifically, as shown in FIG. 2B, the diaphragm 37 is slightly displaced from the top dead point toward the bottom dead point, and pressurizes ink sucked into the pump chamber 43*a* with a predetermined pressure (for example, a pressure of approximately 30 kpa). For this reason, ink is ejected from the pump chamber 43*a*, and the ejection pressure is applied to the upper concave portion 33 of the suction-side valve 41 through the second flow channel 15*b* on an upstream side from the pump chamber 43*a*. The ejection pressure causes the suction-side valve body 36 to be elastically deformed (displaced) downward (that is, in a valve closing direction) in cooperation with the urging force of the coil spring 40. As a result, the first flow channel 15*a* and the second flow channel 15*b* do not communicate with each other as a result of the valve close operation of the suction-side valve body 36. Therefore, suction of ink through the suction-side valve 41 from the ink cartridge 13 into the pump chamber 43*a* is stopped, and ink ejected from the pump chamber 43*a* in accordance with the ejection action of the pump 43 is prevented from flowing back into the ink cartridge 13 through the suction-side valve 41.

When the pump 43 performs the ejection action, the pressure (for example, a pressure of approximately 30 kpa) of ink ejected from the pump chamber 43*a* is also applied to the downstream side of the ink flow channel 15 through the third flow channel 15*c*. For this reason, the ejection pressure of the pump 43 opens the closed ball valve 39, and the pressure accumulation chamber 45*a* defined by the ejection-side valve body 38 of the ejection-side valve 45 and the lower concave portion 32 communicates with the pump chamber 43*a* through the third flow channel 15*c*. As a result, ink is supplied in a pressurized state from the pump chamber 43*a* to the pressure accumulation chamber 45*a* of the ejection-side valve 45 through the third flow channel 15*c*.

When this happens, in the ejection-side valve 45, the ejection-side valve body 38 is elastically deformed (displaced) upward (that is, in a valve opening direction) against the urging force of the coil spring 44 by the pressure of pressurized ink in the pressure accumulation chamber 45*a*. As a result, as shown in FIG. 2B, ink is stored in a pressure-accumulated state in the pressure accumulation chamber 45*a*. For reference, when ink flows into the pressure accumulation chamber 45*a* at an ejection pressure sufficient to open the ball valve 39, the urging force of the coil spring 44 in the ejection-side valve 45 is set to approximately 13 kpa such that the ejection-side valve body 38 can be elastically deformed upward by the ink pressure.

Subsequently, the ejection pressure of ink, which is pressurized by the diaphragm 37 and ejected from the pump chamber 43*a*, is maintained to be balanced over the flow channels (including the pump chamber 43*a* and the pressure accumulation chamber 45*a*) on a downstream side from the upper concave portion 33 of the suction-side valve 41 in the ink flow channel 15. That is, in the pressure accumulation chamber 45*a*, the ejection-side valve body 38 is maintained at the top dead point, and is open such that the pressure accumulation chamber 45*a* and the fourth flow channel 15*d* communicate with each other.

Subsequently, if ink is ejected from the recording head 12 toward a target (not shown), ink is supplied from the ink flow channel 15 to the recording head 12 through the self-sealing valve 17*c*, the buffer 17*b*, and the choke valve 17*a* in an amount corresponding to the amount of ink consumption according to the ejection. For this reason, ink is supplied in a pressurized state from the pump chamber 43*a* to the downstream side, on which the recording head 12 is disposed, through the pressure accumulation chamber 45*a* in an amount corresponding to the amount of ink consumption on the downstream side (the recording head 12) on the basis of a pressing force of the diaphragm 37, which is urged in the direction to decrease the volume of the pump chamber 43*a* by the urging force of the coil spring 42.

Figure 3A:
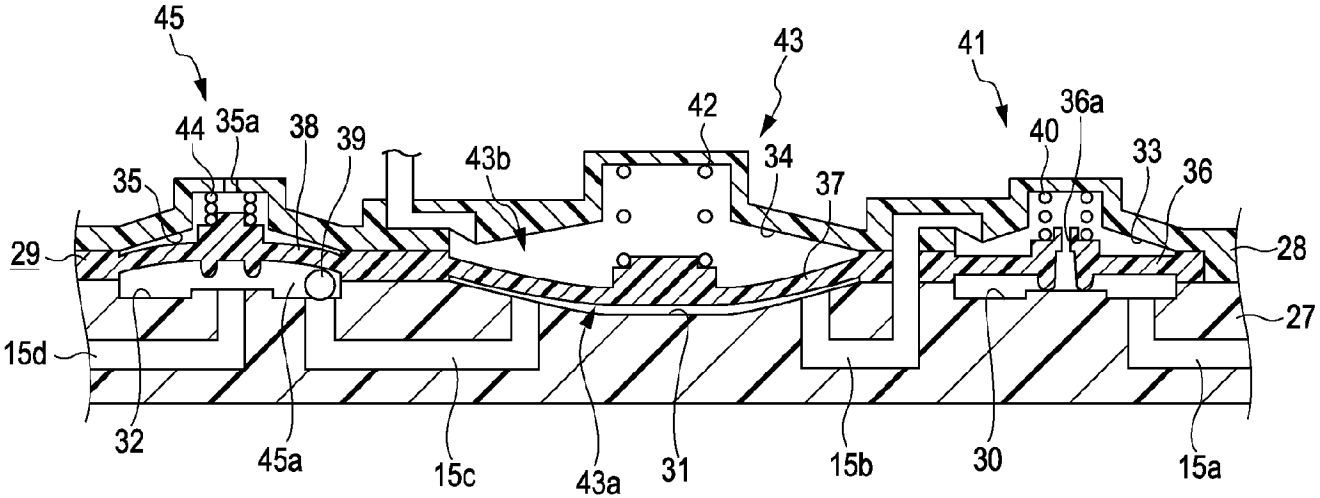
FIG. 3A is a schematic view of a liquid supply device when ink is ejected.

As a result, as shown in FIG. 3A, the volume of the pump chamber 43*a* gradually decreases, and finally the diaphragm 37 is displaced to near the bottom dead point. At this time, the pump chamber 43*a* and the pressure accumulation chamber 45*a* are maintained to be balanced at a pressure of approximately 13 kpa.

That is, the dimension in an expansion-contraction direction of the coil spring 42 urging the diaphragm 37 is changed in accordance with the amount of ink in the pump chamber 43*a*, and thus the urging force to be applied to the pump chamber 43*a* is changed. The urging force of the coil spring 44 urging the pressure accumulation chamber 45*a* is set so as to permit the ejection-side valve body 38 to be displaced at a minimum pressure (for example, a pressure of approximately 13 kpa), which is applied to ink by the coil spring 42 urging the pump chamber 43*a*. For this reason, while the urging force of the coil spring 42 urging the pump chamber 43*a* is changed (for example, a pressure ranging from 30 kpa to 13 kpa) as the diaphragm 37 is displaced from the top dead point to the bottom dead point, the valve open state in which the pressure accumulation chamber 45*a* and the fourth flow channel 15*d* communicate with each other is maintained. That is, while the pump 43 performs the ejection action, the ejection-side valve body 38 is located at the top dead point, and the pressure accumulation chamber 45*a* is maintained to have a maximum volume.

Figure 3B:
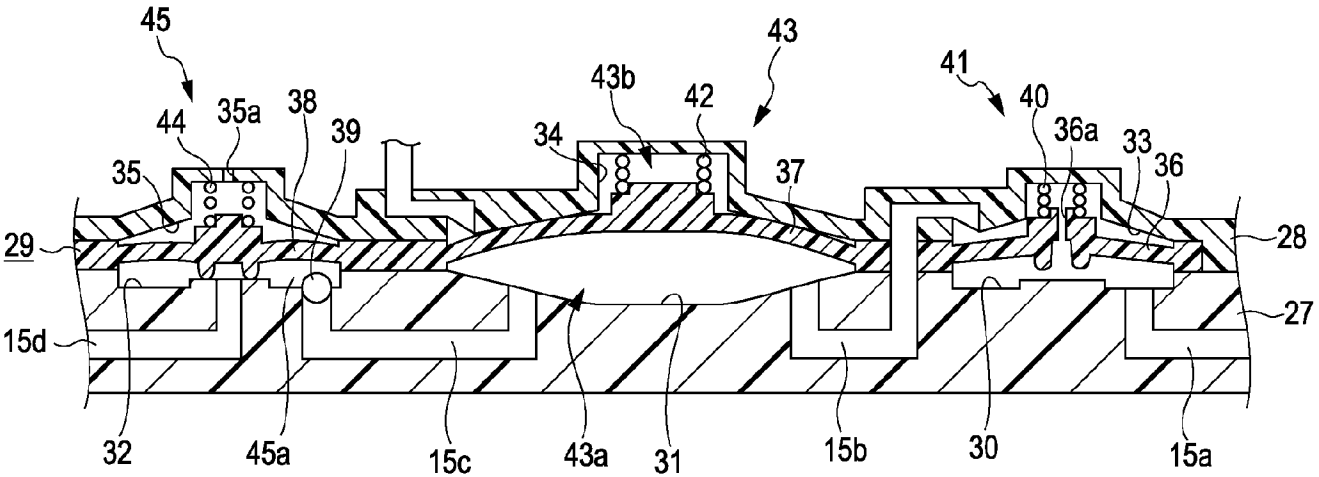
FIG. 3B is a schematic view of a liquid supply device when ink is ejected and a pump performs a suction action.

In the state of FIG. 3A, the driving motor 49 is driven forward again, and in the atmosphere opening mechanism 48, the atmosphere opening valve 53 is displaced to a valve close position to close the atmosphere opening hole 50. In addition, the negative pressure generation device 47 generates negative pressure to put the negative pressure chamber 43*b* in a negative pressure state, and the diaphragm 37 is elastically deformed (displaced) toward the negative pressure chamber 43*b* against the urging force of the coil spring 42. That is, the pump 43 starts the suction action again. As a result, as shown in FIG. 3B, the diaphragm 37 is displaced to the top dead point so as to increase the volume of the pump chamber 43*a*, and the pump chamber 43*a* is put in the negative pressure state. The negative pressure causes the suction-side valve body 36 to be elastically deformed (displaced) in the valve opening direction. Therefore, the first flow channel 15*a* and the second flow channel 15*b* communicate with each other through the through hole 36*a* of the suction-side valve body 36, and ink is sucked from the ink cartridge 13 to the pump chamber 43*a* again.

Meanwhile, in the pressure accumulation chamber 45*a* on a downstream side from the pump chamber 43*a*, the pressure in the pump chamber 43*a* is decreased with respect to the pressure in the pressure accumulation chamber 45*a*, and thus the ball valve 39 is displaced to a valve close position. For this reason, in the pressure accumulation chamber 45*a*, the ejection-side valve body 38 is pressed by the coil spring 44. Accordingly, while the pump 43 performs the suction action, ink is continued to be pressurized and supplied toward the recording head 12 on the downstream side through the fourth flow channel 15*d*, which is communicating with the pressure accumulation chamber 45*a*. Thereafter, the pump 43 performs the same ejection action as described above, and thus ink is pressurized and supplied from the pump chamber 43*a* to the recording head 12 through the pressure accumulation chamber 45*a* on the downstream side.

According to the ink supply device 14 and the printer 11 of the foregoing embodiment, the following effects can be obtained.

(1) If the pump 43 performs the pump action, ink is sucked into the pump chamber 43*a* from the upstream side, on which the ink cartridge 13 is disposed, through the suction-side valve 41, and ink is ejected from the pump chamber 43*a* toward the downstream side and passes through the ball valve 39. Ink passing through the ball valve 39 is temporarily stored in the pressure accumulation chamber 45*a*. In this case, the urging force of the coil spring 44 is applied to the volume variable pressure accumulation chamber 45*a* in a direction to decrease the volume of the pressure accumulation chamber 45*a*. Therefore, ink is stored in the pressure accumulation chamber 45*a* in a pressure-accumulated state. A backflow of ink stored in the pressure-accumulated state toward the pump chamber 43*a* is suppressed by the ball valve 39, and ink is pressurized and supplied toward the downstream side, on which ink is consumed. For this reason, ink can be stably pressurized and supplied from the upstream side, on which the ink cartridge 13 is disposed, toward the downstream side, on which ink is consumed, without adversely affecting the state of the pump 43, which repeatedly performs the ink suction and ejection actions.

(2) The urging force of the coil spring 44 is applied in the direction to decrease the volume of the pressure accumulation chamber 45*a*. Therefore, ink that flows from the pump chamber 43*a* on the upstream side into the pressure accumulation chamber 45*a* forming a part of the ink flow channel 15 through the ball valve 39 can be maintained in the pressurized and pressure-accumulated state. As a result, ink stored in the pressure accumulation chamber 45*a* can be stably supplied to the downstream side in a pressurized state.

(3) If the pump 43 performs a pump action, ink is sucked into the pump chamber 43*a* from the upstream side, on which the ink cartridge 13 is disposed, through the suction-side valve 41, and ink is ejected from the pump chamber 43*a* toward the downstream side and passes through the ball valve 39. Ink passing through the ball valve 39 is temporarily stored in the ejection-side valve 45 in the pressure-accumulated state. A backflow of ink stored in the ejection-side valve 45 in the pressure-accumulated state toward the pump chamber 43*a* is suppressed by the ball valve 39, and ink is pressurized and supplied toward the downstream side, on which ink is consumed. For this reason, ink can be stably pressurized and supplied from the upstream side, on which the ink cartridge 13 is disposed, toward the downstream side, on which ink is consumed, without adversely affecting the state of the pump 43, which repeatedly performs the ink suction and ejection actions.

(4) Ink that flows into the pressure accumulation chamber 45*a*, which forms a part of the ink flow channel 15, from the pump chamber 43*a* on the upstream side through the ball valve 39 is displaced by the ejection-side valve body 38 against the urging force. Therefore, ink can be stored in the pressure-accumulated state. In addition, ink stored in the pressure-accumulated state is displaced by the ejection-side valve body 38 in an urging direction. As a result, ink can be stably supplied from the pressure accumulation chamber 45*a* to the downstream side in a pressurized state.

(5) Ink in the pressure-accumulated state flows out to the downstream side from the pressure accumulation chamber 45*a* as ink is consumed on the downstream side, and the volume of the pressure accumulation chamber 45*a* is gradually decreased. For this reason, the pressure of ink in the pressure accumulation chamber 45*a* is gradually decreased. Meanwhile, if ink ejected from the pump chamber 43*a* in accordance with the ejection action of the pump 43 newly flows into the pressure accumulation chamber 45*a*, the volume of the pressure accumulation chamber 45*a* is increased again, and the pressure of ink in the pressure accumulation chamber 45*a* is increased. Therefore, the pump action can be performed at an appropriate timing, and as a result ink can be constantly pressurized and supplied to the downstream side, on which ink is consumed.

(6) When the pump 43 performs a pump action to supply ink, the diaphragm 37 is configured to be displaced against the urging force of the coil spring 42 only if the pump 43 performs one of the suction action and the ejection action. Otherwise, the diaphragm 37 is displaced to an original state by the urging force of the coil spring 42. Therefore, a drive load of the pump 43 can be reduced.

(7) The portions of the single flexible member 29 corresponding to the pump chamber 43*a* and the pressure accumulation chamber 45*a* are individually used as the diaphragm 37 of the pump 43 and the ejection-side valve body 38 of the ejection-side valve 45. Therefore, the number of parts of the device can be reduced.

(8) In the flexible member 29 forming the diaphragm 37 of the pump 43 and the ejection-side valve body 38 of and the ejection-side valve 45, the portion corresponding to the pressure accumulation chamber 45*a* is urged by the coil spring 44. Therefore, ink stored in the pressure accumulation chamber 45*a* is displaced by the ejection-side valve body 38 in the urging direction. As a result, ink can be stably supplied from the pressure accumulation chamber 45*a* toward the downstream side in the pressurized state.

(9) The portions of the single flexible member 29 corresponding to pump chamber 43*a*, the pressure accumulation chamber 45*a*, and the suction-side valve 41 are individually used as the diaphragm 37 of the pump 43, the ejection-side valve body 38 of the ejection-side valve 45, and the suction-side valve body 36 of the suction-side valve 41. Therefore, the number of parts of the device can be reduced.

(10) Ink is supplied in the pressurized state from the ejection-side valve 45, which stores ink in the ink flow channel 15 between the pump chamber 43*a* and the recording head 12 in the pressure-accumulated state, to the recording head 12 on the downstream side. For this reason, the pump 43, which is provided in the ink flow channel 15 and performs the pump action to supply ink to the downstream side, that is, to the recording head 12, does not need to apply excessive pressure to ink. Therefore, the pump 43 can be reduced in size, and as a result the printer 11 can be reduced in size.

(11) Ink supplied from the ink supply device 14 is temporarily stored in the buffer 17*b* and the pressure chamber of the self-sealing valve 17*c*, and ink is supplied to the recording head 12 from the buffer 17*b* and the pressure chamber in an amount corresponding to the amount of ink supplied to the nozzle 16 on the basis of the valve open operation of the self-sealing valve 17*c*, that is, the amount of ink consumed by ejection from the recording head 12. For this reason, pressurized ink can be prevented from being directly supplied to the recording head 12, and thus ink leakage from the recording head 12 can be suppressed. In addition, since the buffer 17*b* is provided, ink is stored in the pressure accumulation chamber 45*a* and the buffer 17*b*. For this reason, when the pump 43 performs the suction action, the amount of ink to be ejected from the recording head 12 can be increased.

The foregoing embodiment may be modified as follows.

In the recording head 12, one or two of the choke valve 17*a*, the buffer 17*b*, and the self-sealing valve 17*c* may be provided, or the choke valve 17*a*, the buffer 17*b*, and the self-sealing valve 17*c* may not be provided. The choke valve 17*a*, the buffer 17*b*, and the self-sealing valve 17*c* may be provided in the fourth flow channel 15*d* or the ink supply tube 15*e*.

The ball valve 39 may be provided in the third flow channel 15*c* or the upstream end of the third flow channel 15*c* insofar as it permits ink to flow from the pump 43 toward the ejection-side valve 45. The second one-way valve may be formed of a check valve-type one-way valve (for example, a valve, such as the suction-side valve 41) instead of the ball valve 39.

As the one-way valve (the ball valve 39 or the suction-side valve 41), a choke member may be arranged at the bottom of the concave portion 30 or 32 such that its front end closes the downstream-side opening end of the first flow channel 15*a* or the third flow channel 15*c*, and its base end is fixed in a cantilever manner. At least the front end of the choke member is preferably larger than the opening diameter of the first flow channel 15*a* or the third flow channel 15*c*. Accordingly, when the pressure on the downstream side from the choke member is larger than the pressure on the upstream side (that is, the pressure in the first flow channel 15*a* or the third flow channel 15*c*), the choke member closes the first flow channel 15*a* or the third flow channel 15*c*, and thus the flow of ink is blocked. Meanwhile, when the pressure on the upstream side from the choke member is larger than the pressure on the downstream side, the front end of the choke member is elastically deformed so as to be away from the opening of the first flow channel 15*a* or the third flow channel 15*c*. Therefore, ink flows from the upstream side to the downstream side.

As a driving source of the pump 43, a positive pressure generation device may be used, instead of the negative pressure generation device 47. As the coil spring 42 serving as an urging member, a tension spring may be used, instead of a compression spring. The coil spring 42 formed of a compression spring may be provided in the pump chamber 43*a*, not in the negative pressure chamber 43*b*. In this modification, when the pump 43 performs the suction action, the diaphragm 37 is displaced by the urging force of the spring in a direction to increase the volume of the pump chamber 43*a*. Meanwhile, when the pump 43 performs the ejection action, pressurized air is introduced from the positive pressure generation device into the upper concave portion 34 of the pump 43 (in this embodiment, the negative pressure chamber 43*b*).

Instead of the negative pressure generation device 47 or the positive pressure generation device, a cam mechanism may be used as a mechanism for displacing the diaphragm 37. That is, a base end of a traction member having a locking portion is fixed to the diaphragm 37, which is pressed by the coil spring 42 formed of a compression spring, and a cam member is brought into contact with the locking portion of the traction member. Therefore, the diaphragm 37 is displaced by the traction member. In addition, when a tension spring is used, a base end of a pressing member may be fixed to the diaphragm 37, and a front end of the pressing member may be pressed against the diaphragm 37 by a cam member.

As a driving source of the pump 43, a device having functions of the positive pressure generation device and the negative pressure generation device 47 may be used. In this case, positive pressure and negative pressure are alternately generated. Therefore, the diaphragm 37 can be displaced to perform the pump action, without providing an urging member, and thus ink can be supplied.

The pump 43 and the pressure accumulation chamber 45*a* may use urging members, other than a coil spring and rubber, in order to apply the urging force to urge the diaphragm 37 and the ejection-side valve body 38. With such urging members, the urging force to be applied to the ink in the pump chamber 43*a* and the pressure accumulation chamber 45*a* can be maintained, regardless of the state of the negative pressure generation device 47.

The pump 43 may be a piston pump in which a piston reciprocates in the negative pressure chamber 43*b* and directly presses the pump chamber 43*a*, and the volume of the pump chamber 43*a* is changed in accordance with the reciprocation. Similarly, the pressure accumulation chamber 45*a* may have a piston structure.

The pressure accumulation chamber 45*a* may not have the atmosphere communicating hole 35*a*, or may not have the coil spring 44 and the atmosphere communicating hole 35*a*. In this case, since the concave portion 35 is sealed by the ejection-side valve body 38, the volume of the concave portion 35 decreases in accordance with the amount of ink flowing in the pressure accumulation chamber 45*a*. For this reason, the pressure of compressed air is applied from the concave portion 35 to the pressure accumulation chamber 45*a*.

The flexible member 29 forming the suction-side valve 41, the pump 43, and the ejection-side valve 45 is formed as a single body, but separate flexible members 29 may be provided. In addition, the suction-side valve 41 and the pump 43, the suction-side valve 41 and the ejection-side valve 45, or the pump 43 and the ejection-side valve 45 may be selectively formed of a single flexible member 29.

As the ejection-side valve 45, a solenoid valve may be used. The valve may be opened when the amount of ink in the ejection-side valve 45 decreases or while ink is ejected from the nozzle 16. Alternatively, the valve may be opened only when the pump 43 is sucking ink.

The term "liquid" used herein includes a liquid other than ink (an inorganic solvent, an organic solvent, a solution, a liquid resin, or a liquid metal (metal melt)), a liquid state material, in which particles of function material are dispersed or mixed, a fluid state material, such as gel. A liquid ejecting apparatus that ejects or discharges the "liquid" may be a liquid state material ejecting apparatus that ejects a liquid state material, in which an electrode material or a color material (pixel material) is dispersed or dissolved and is used in manufacturing a liquid crystal display, an EL (Electro Luminescence) display, or a field emission display, a liquid ejecting apparatus that ejects a bioorganic material to be used in manufacturing a bio-chip, or a liquid ejecting apparatus that ejects a liquid (sample) as a precision pipette. In addition, it may be a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, a liquid ejecting apparatus that ejects an etchant, such as acid or alkali, to etch a substrate, or a liquid ejecting apparatus that ejects a liquid state material, such as gel (for example, physical gel).

Although in the foregoing embodiment, the liquid ejecting apparatus is embodied in the ink jet printer 11, it may be embodied in a liquid ejecting apparatus that ejects or discharges a liquid other than ink. The invention may be used in various liquid ejecting apparatuses that have liquid ejecting head for ejecting a small amount of liquid droplets. The liquid droplet means the state of a liquid to be ejected from the liquid ejecting apparatus, and includes a granular shape, a teardrop shape, and a tailed threadlike shape. Any liquid may be used insofar as it can be ejected from the liquid ejecting apparatus. For example, a material of a liquid phase is preferably used. In addition, a fluid state material, such as a liquid state material having high or low viscosity, sol, gel water, an inorganic solvent, an organic solvent, a solution, a liquid resin, or a liquid metal (metal melt), may be used. In addition to a liquid as one state of a material, a material, which is obtained by dissolving, dispersing, or mixing particles of function material containing solid material, such as pigment or metal particles, in a solvent, may be used. As the liquid, ink described in the foregoing embodiment or liquid crystal may be exemplified. Ink includes various liquid compositions, such as aqueous ink, oil-based ink, gel ink, and hot-melt ink. Specific examples of the liquid ejecting apparatus include a liquid ejecting apparatus that ejects a liquid, in which a material, such as an electrode material or a color material, is dispersed or dissolved, and is used in manufacturing a liquid crystal display, an EL (Electro Luminescence) display, a field emission display, and color filters, a liquid ejecting apparatus that ejects a bioorganic material to be used in manufacturing a bio-chip, a liquid ejecting apparatus that ejects a liquid (sample) as a precision pipette, a textile printing apparatus, and a micro dispenser. In addition, a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, and a liquid ejecting apparatus that ejects an etchant, such as acid or alkali, to etch a substrate may be used. The invention may be applied to one of the liquid ejecting apparatuses.

Although air is used as the working fluid of the pump 43, a liquid, such as silicon oil, may be used as the working fluid.

What is claimed is:

1. A liquid supply device comprising:

a liquid supply channel that supplies a liquid from an upstream side as a liquid supply source side to a downstream side, on which the liquid is consumed;

a pump that pumps a part of the liquid supply channel as a pump chamber;

a first one-way valve that is provided in the liquid supply channel on an upstream side from the pump chamber to permit the liquid to flow only in a direction from the upstream side to the downstream side;

a second one-way valve that is provided in the liquid supply channel on a downstream side from the pump chamber to permit the liquid to flow only in a direction from the upstream side to the downstream side; and a liquid pressure accumulation unit that is provided in the liquid supply channel on a downstream side from the second one-way valve and stores the liquid in a pressure-accumulated state, wherein the liquid pressure accumulation unit includes an urging unit that applies a predetermined urging force in a direction to decrease the volume of the pressure accumulation chamber.

2. A liquid supply device comprising:

a liquid supply channel that supplies a liquid from an upstream side as a liquid supply source side to a downstream side, on which the liquid is consumed;

a pump that pumps a part of the liquid supply channel as a pump chamber;

a first one-way valve that is provided in the liquid supply channel on an upstream side from the pump chamber to permit the liquid to flow only in a direction from the upstream side to the downstream side;

a second one-way valve that is provided in the liquid supply channel on a downstream side from the pump chamber to permit the liquid to flow only in a direction from the upstream side to the downstream side; and a liquid pressure accumulation unit that is provided in the liquid supply channel on a downstream side from the second one-way valve and stores the liquid in a pressure-accumulated state, wherein the liquid pressure accumulation unit includes a volume variable pressure accumulation chamber that forms a part of the liquid supply channel, and a displacement member that is displaceable to increase and decrease the volume of the pressure accumulation chamber, and is constantly urged by a predetermined urging force so as to be displaced in a direction to decrease the volume of the pressure accumulation chamber.

3. The liquid supply device according to claim 2, wherein, when the pressure of the liquid ejected from the pump chamber in accordance with an ejection action of the pump is applied as positive pressure, the displacement member is displaced in a direction to increase the volume of the pressure accumulation chamber against the urging force.

4. The liquid supply device according to claim 2, wherein the pump includes a displacement member that is displaced so as to increase and decrease the volume of the pump chamber, and an urging member that urges the displacement member in a direction to decrease or increase the volume of the pump chamber.

5. The liquid supply device according to claim 4, wherein the displacement member of the pump and the displacement member of the liquid pressure accumulation unit are formed of a single flexible member.

6. The liquid supply device according to claim 5, wherein a portion of the single flexible member corresponding to the pump chamber is displaced so as to increase and decrease the volume of the pump chamber when the pump performs a pump action, and a portion of the single flexible member corresponding to the pressure accumulation chamber is urged by a predetermined urging force so as to be displaced in a direction to decrease the volume of the pressure accumulation chamber.

7. The liquid supply device according to claim 4, wherein the first one-way valve includes a displacement member that is displaced in a direction to permit the liquid to flow in the liquid supply channel when the pressure of the liquid sucked into the pump chamber in accordance with the suction action of the pump is applied as negative pressure, and the displacement member of the first one-way valve and at least one of the displacement member of the pump and the displacement member of the liquid pressure accumulation unit are formed of a single flexible member.

8. A liquid ejecting apparatus comprising:

a liquid ejecting head that ejects a liquid; and the liquid supply device according to claim 2, which supplies the liquid to the liquid ejecting head.

9. The liquid ejecting apparatus according to claim 8, wherein, when the liquid ejecting head ejects the liquid and consumes the liquid, the liquid is supplied to the liquid ejecting head from a valve unit, which temporarily stores the liquid to be supplied from the liquid supply device, in an amount corresponding to the amount of the liquid consumed by the ejection.

* * * * *